US008340550B2

(12) United States Patent
Hoshino et al.

(10) Patent No.: US 8,340,550 B2
(45) Date of Patent: Dec. 25, 2012

(54) TRANSFER DEVICE AND IMAGE FORMING DEVICE

(75) Inventors: Takashi Hoshino, Kanagawa (JP); Chihiro Iijima, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 307 days.

(21) Appl. No.: 12/905,845

(22) Filed: Oct. 15, 2010

(65) Prior Publication Data

US 2011/0188890 A1 Aug. 4, 2011

(30) Foreign Application Priority Data

Jan. 29, 2010 (JP) ..... 2010-019294

(51) Int. Cl.
*G03G 15/08* (2006.01)

(52) U.S. Cl. ..... 399/121; 399/165; 399/302; 399/303

(58) Field of Classification Search ..... 399/107, 399/110, 121, 162–165, 302, 303, 308
See application file for complete search history.

(56) References Cited

U.S. PATENT DOCUMENTS 6,990,304 B2 * 1/2006 Mitamura et al. ..... 399/167

FOREIGN PATENT DOCUMENTS

| | | | |
|---|---|---|---|
| JP | 62-242963 | * | 10/1987 |
| JP | 09-160437 | A | 6/1997 |
| JP | 2003-195596 | A | 7/2003 |
| JP | 2005-316320 | A | 11/2005 |
| JP | 2008-076449 | A | 4/2008 |

* cited by examiner

*Primary Examiner* — Hoan Tran
(74) *Attorney, Agent, or Firm* — Sughrue Mion, PLLC

(57) ABSTRACT

A transfer device includes: an endless transfer-belt that includes a first transfer-portion, at which a developer image is transferred onto an outer periphery surface of the transfer-belt, and a second transfer-portion, at which the developer image is transferred onto a member-to-be-transferred, the transfer-belt moving toward the second transfer-portion from the first transfer-portion; a transfer-member that, at the second transfer-portion, sandwiches the member-to-be-transferred between the transfer-member and the transfer-belt, and transfers the developer image to the member-to-be-transferred; a tension application unit that includes a resilient member, and a tension application member that urges the transfer-belt with resilient force of the resilient member and applies tension to the transfer-belt; and a damping member that causes damping force to act on the tension application member when the tension application member moves in one of a direction in which the tension application member urges the transfer-belt, or an opposite direction.

14 Claims, 7 Drawing Sheets

TRANSFER DEVICE AND IMAGE FORMING DEVICE

CROSS-REFERENCE TO RELATED APPLICATION

This application is based on and claims priority under 35 USC 119 from Japanese Patent Application No. 2010-019294 filed Jan. 29, 2010.

BACKGROUND

Technical Field

The present invention relates to a transfer device and an image forming device.

SUMMARY

A transfer device of an aspect of the present invention includes: an endless transfer belt that includes a first transfer portion, at which a developer image is transferred onto an outer periphery surface of the transfer belt, and a second transfer portion, at which the developer image is transferred onto a member to be transferred, the transfer belt moving toward the second transfer portion from the first transfer portion; a transfer member that, at the second transfer portion, sandwiches the member to be transferred between the transfer member and the transfer belt, and transfers the developer image to the member to be transferred; a tension application unit that includes a resilient member, and a tension application member that urges the transfer belt with resilient force of the resilient member and applies tension to the transfer belt; and a damping member that causes damping force to act on the tension application member when the tension application member moves in one of a direction in which the tension application member urges the transfer belt, or an opposite direction.

BRIEF DESCRIPTION OF THE DRAWINGS

Exemplary embodiments of the invention will be described in detail with reference to the following figures, wherein.

DETAILED DESCRIPTION

Examples of a transfer device and an image forming device relating to an exemplary embodiment of the present invention are described.

Figure 1:
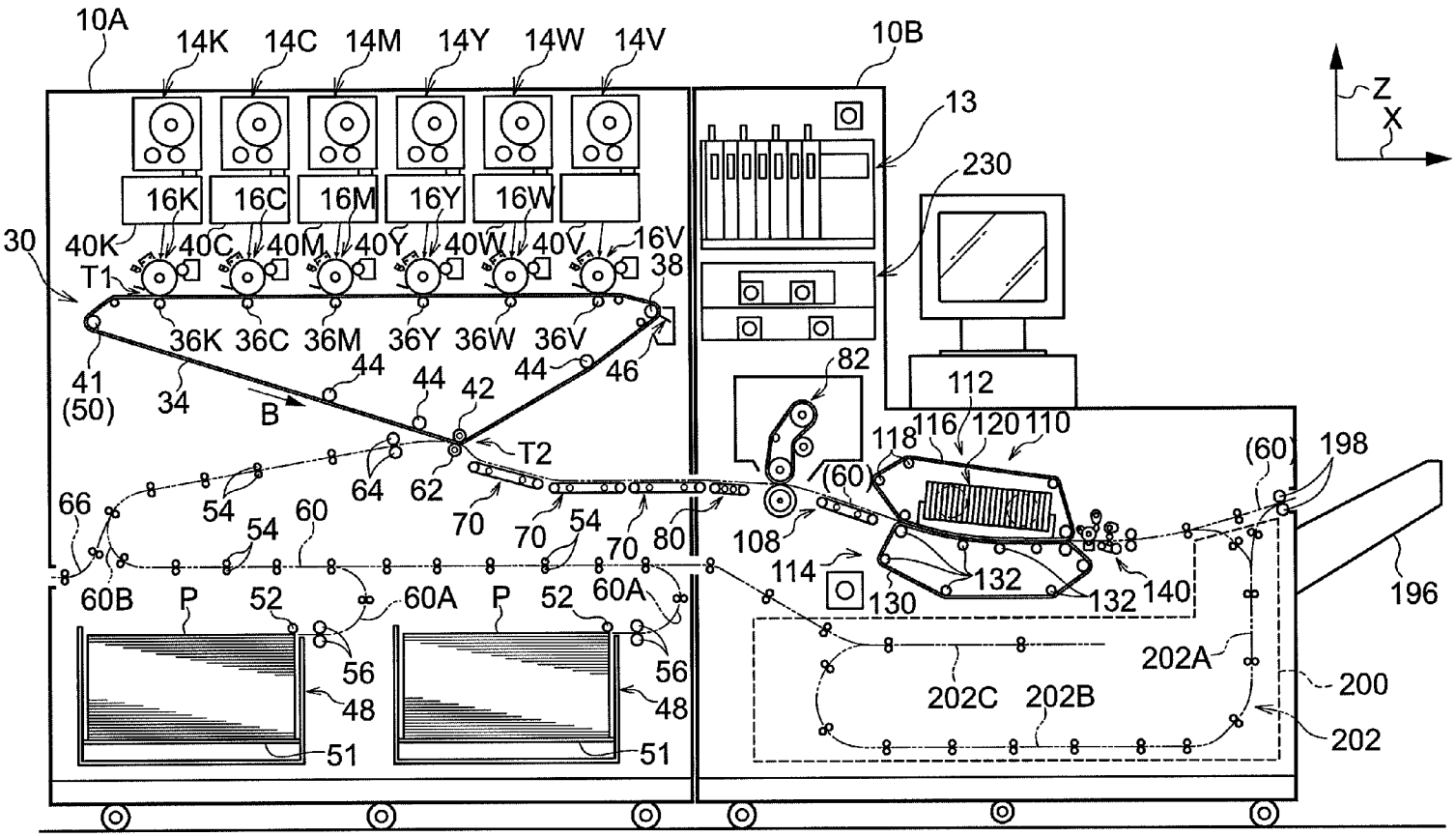
FIG. 1 is an overall diagram of an image forming device relating to an exemplary embodiment of the present invention.

As illustrated in FIG. 1, an image forming device 10 relating to the present exemplary embodiment, which forms color images or black and white images, includes a first processing section 10A and a second processing section 10B. The first processing section 10A is disposed at the left side in a front view. The second processing section 10B is attachable and detachable at the first processing section 10A and is disposed at the right side. Casings of the first processing section 10A and the second processing section 10B are structured by plural frame members.

A control section 13 is provided at the upper side in a vertical direction (the direction of arrow Z) of the interior of the second processing section 10B. The control section 13 includes an image signal processing section that applies image processing to image data sent thereto from a computer. The control section 13 performs driving control of respective sections of the image forming device 10. A power supply unit 230 is provided below the control section 13. The power supply unit 230 converts AC current received from the outside to DC current and supplies power to respective sections of the image forming device 10.

At the vertical direction upper side of the interior of the first processing section 10A, toner cartridges 14V, 14W, 14Y, 14M, 14C and 14K are removably provided, side by side in a horizontal direction. The toner cartridges 14V, 14W, 14Y, 14M, 14C and 14K accommodate toners (developers) of a first special color (V), a second special color (W), yellow (Y), magenta (M), cyan (C) and black (K). The first special color and the second special color are selected from special colors (including transparent) other than yellow, magenta, cyan and black. In the descriptions herebelow, where V, W, Y, M, C and K are to be distinguished, descriptions are given with any of the letters V, W, Y, M, C and K appended to the end of reference numerals, and where V, W, Y, M, C and K are not to be distinguished, the letters V, W, Y, M, C and K are omitted.

Below the toner cartridges 14, six image forming units 16 are disposed side by side in the horizontal direction, in correspondence with the toner cartridges 14. The image forming units 16 serve as examples of developer image forming units corresponding to the respective toners. Exposure units 40 are also disposed below the toner cartridges 14. The exposure units 40 serve as examples of developer image forming units for the respective image forming units 16. The exposure units 40 are configured to receive image data that has been subjected to image processing from the above-mentioned control section 13, modulate semiconductor lasers (not illustrated) in accordance with colorant modulation data, and emit exposure lights L from these semiconductor lasers. More specifically, the exposure lights L corresponding to the respective colors are illuminated onto surfaces of photoreceptors 18 (see FIG. 2), which are described below, and form electrostatic latent images on the photoreceptors 18.

Figure 2:
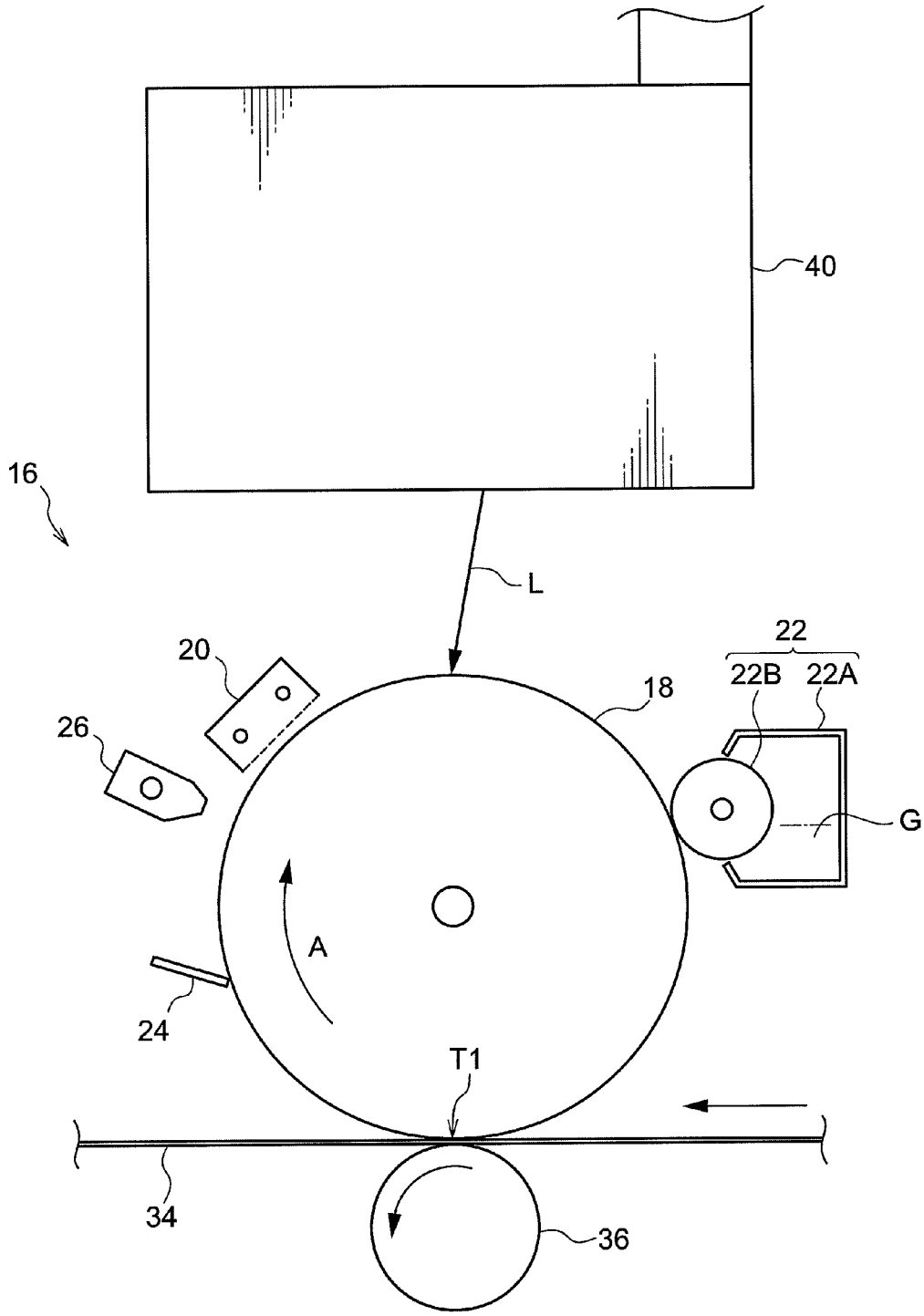
FIG. 2 is a structural diagram of an image forming unit relating to the exemplary embodiment of the present invention.

As illustrated in FIG. 2, each image forming unit 16 is provided with the photoreceptor 18, which is driven to rotate in the direction of arrow A (the clockwise direction in FIG. 2). A scorotron charger 20, a developing device 22, a cleaning blade 24 and an erasure lamp 26 are provided around the photoreceptor 18. The scorotron charger 20 is a charger of a corona discharge type (a non-contact electrostatic type) that charges up the photoreceptor 18. The developing device 22 develops an electrostatic latent image that has been formed on the photoreceptor 18 by the exposure light L emitted by the exposure unit 40, with the developer (toner) of the respective color. The cleaning blade 24 cleans the surface of the photoreceptor 18. The erasure lamp 26 illuminates light onto the surface of the photoreceptor 18 after a transfer and de-electrifies the surface. The scorotron charger 20, the developing device 22, the cleaning blade 24 and the erasure lamp 26 are disposed to oppose the surface of the photoreceptor 18 in this order from the upstream side to the downstream side of the direction of rotation of the photoreceptor 18.

The developing device 22 is disposed to sideward of the image forming unit 16 (a paper surface right side in the drawing in the present exemplary embodiment), and is structured to include a developer accommodation member 22A and a developing roller 22B. The developer accommodation member 22A is charged with a developer G that includes the toner. The developing roller 22B moves the toner charged into the developer accommodation member 22A to the surface of the photoreceptor 18. The developer accommodation member 22A is connected with the toner cartridge 14 (see FIG. 1) via a toner supply path (not illustrated), and is supplied with toner from the toner cartridge 14.

As illustrated in FIG. 1, a transfer device 30 is disposed below the image forming units 16. Details of the transfer device 30 are described below. Below the transfer device 30, at the lower side of the first processing section 10A, two large paper supply cassettes 48 in which sheet members P are accommodated are disposed side by side in a horizontal direction (the direction of arrow X). The sheet member P serves as an example of a member to be transferred. The sheet members P may be accommodated in large quantities by the paper supply cassettes 48. Because the two paper supply cassettes 48 have similar structures, only one of the paper supply cassettes 48 is described and no description is given for the other paper supply cassette 48.

The paper supply cassette 48 is withdrawable from the first processing section 10A. When the paper supply cassette 48 is withdrawn from the first processing section 10A, a bottom plate 51, upon which the sheet members P disposed in the paper supply cassette 48 are placed, descends in accordance with the direction of an unillustrated control portion. Due to that the bottom plate 51 descends, a user may resupply the sheet members P. When the paper supply cassette 48 is attached to the first processing section 10A, the bottom plate 51 ascends in accordance with the direction of the control portion. A feedout roller 52 is disposed above one end side of the paper supply cassette 48. The feedout roller 52 feeds out the sheet members P from the paper supply cassette 48 to a transport path 60. The feedout roller 52 touches against the sheet member P that is placed in the topmost position on the ascending bottom plate 51. Separation rollers 56 that prevent multiple feeding of the sheet members P are provided at the downstream side of the sheet member P transport direction relative to the feedout roller 52 (hereinafter simply referred to as the downstream side). Plural transport rollers 54 are disposed at the downstream side of the separation rollers 56. The transport rollers 54 transport the sheet members P downstream.

The transport path 60 provided above the paper supply cassette 48 turns a sheet member P fed out from the paper supply cassette 48 back to the opposite side (the left side in the drawing) at a first turnback portion 60A, and then turns the sheet member P back to the opposite side at a second turnback portion 60B (the right side in the drawing). So, the transport path 60 extends to a second transfer portion T2, which is sandwiched between a second transfer roller 62 and a support roller 42, which are described below.

An aligner (not illustrated) is disposed at a location between the second turnback portion 60B and the second transfer portion T2. The aligner corrects slanting or the like of the sheet member P that is being transported. Positioning rollers 64 are disposed at a location between the aligner and the second transfer portion T2. The positioning rollers 64 are for matching a movement timing of a toner image on an intermediate transfer belt 34 with a transport timing of the sheet member P.

A preparatory path 66 that extends from a side face of the first processing section 10A is provided so as to merge with the second turnback portion 60B of the transport path 60. Sheet members P that are fed from an externally mounted large-capacity stacking section (not illustrated), which is disposed adjacent to the first processing section 10A, pass along the preparatory path 66 and into the transport path 60.

Plural transport portions 70, which transport a sheet member P to which a toner image has been transferred toward the second processing section 10B, are provided at the downstream side of the second transfer portion T2. The transport portions 70 are provided with a plural number of belt members that are wound round unillustrated driving rollers and following rollers. The driving rollers are driven to rotate and cause the belt members to turn. Thus, the sheet member P is transported to the downstream side.

The downstream side of the transport portions 70 extends from the first processing section 10A into the second processing section 10B. A sheet member P that is fed out by the transport portions 70 is received by a transport device 80 disposed in the second processing section 10B, and is transported further downstream. A fixing unit 82 is disposed at the downstream side of the transport device 80. The fixing unit 82 fixes a toner image that has been transferred onto the surface of the sheet member P to the sheet member P with heat and pressure.

A transport section 108 is disposed at the downstream side of the fixing unit 82. The transport section 108 transports the sheet member P that is fed out from the fixing unit 82 downstream. A cooling unit 110 is disposed at the downstream side of the transport section 108. The cooling unit 110 cools the sheet member P that has been pressed and heated by the fixing unit 82. The cooling unit 110 includes an upper side transport unit 112, a lower side transport unit 114, and a cooling portion 120. The upper side transport unit 112 is disposed at the upper side and the lower side transport unit 114 is disposed at the lower side, sandwiching the transport path 60 of the sheet member P. The cooling portion 120 is formed with a heat sink that cools the sheet member P that is being transported.

The upper side transport unit 112 is structured to include an endless heat-receiving belt 116 and plural roller members 118. The heat-receiving belt 116 touches against the face of the sheet member P on which the image is formed and absorbs heat from the sheet member P, and transports the sheet member P. The roller members 118 touch against an inner periphery face of the heat-receiving belt 116 and drive/support the heat-receiving belt 116. The heat-receiving belt 116 is movable to circulate in the counterclockwise direction of FIG. 1.

The lower side transport unit 114 is structured to include an endless transport belt 130 and plural roller members 132. The transport belt 130 is disposed such that an outer periphery face thereof opposes the heat-receiving belt 116, touches against a lower face of the sheet member P and presses the sheet member P against the heat-receiving belt 116, and transports the sheet member P. The roller members 132 touch against the inner peripheral face of the transport belt 130 and drive/support the transport belt 130. The transport belt 130 is movable to circulate in the clockwise direction of FIG. 1.

A decurling processing unit 140 is disposed at the downstream side of the cooling unit 110. The decurling processing unit 140 rectifies curl of the sheet member P. An ejection roller 198 is disposed downstream of the decurling processing unit 140. The ejection roller 198 ejects a sheet member P on one face of which an image has been formed to an ejection section 196 attached to a side face of the second processing section 10B. In a case where images are to be formed at both faces of a sheet member P, the sheet member P is transported into an inversion unit 200 that is disposed at the downstream side of the decurling processing unit 140.

An inversion path 202 is provided in the inversion unit 200. A branch path 202A, a paper transport path 202B and an inversion path 202C are provided in the inversion path 202. The branch path 202A branches from the transport path 60. The paper transport path 202B transports a sheet member P being transported along the branch path 202A toward the first processing section 10A. The inversion path 202C turns the sheet member P being transported along the paper transport path 202B to the opposite direction, performs switchback transport, and inverts the sheet member P front to back. With this structure, the sheet member P that has been switchback-transported by the inversion path 202C is transported toward the first processing section 10A, then enters the transport path 60 provided above the paper supply cassettes 48, and is fed into the second transfer portion T2 again.

Next, the transfer device 30 is described.

Figure 3:
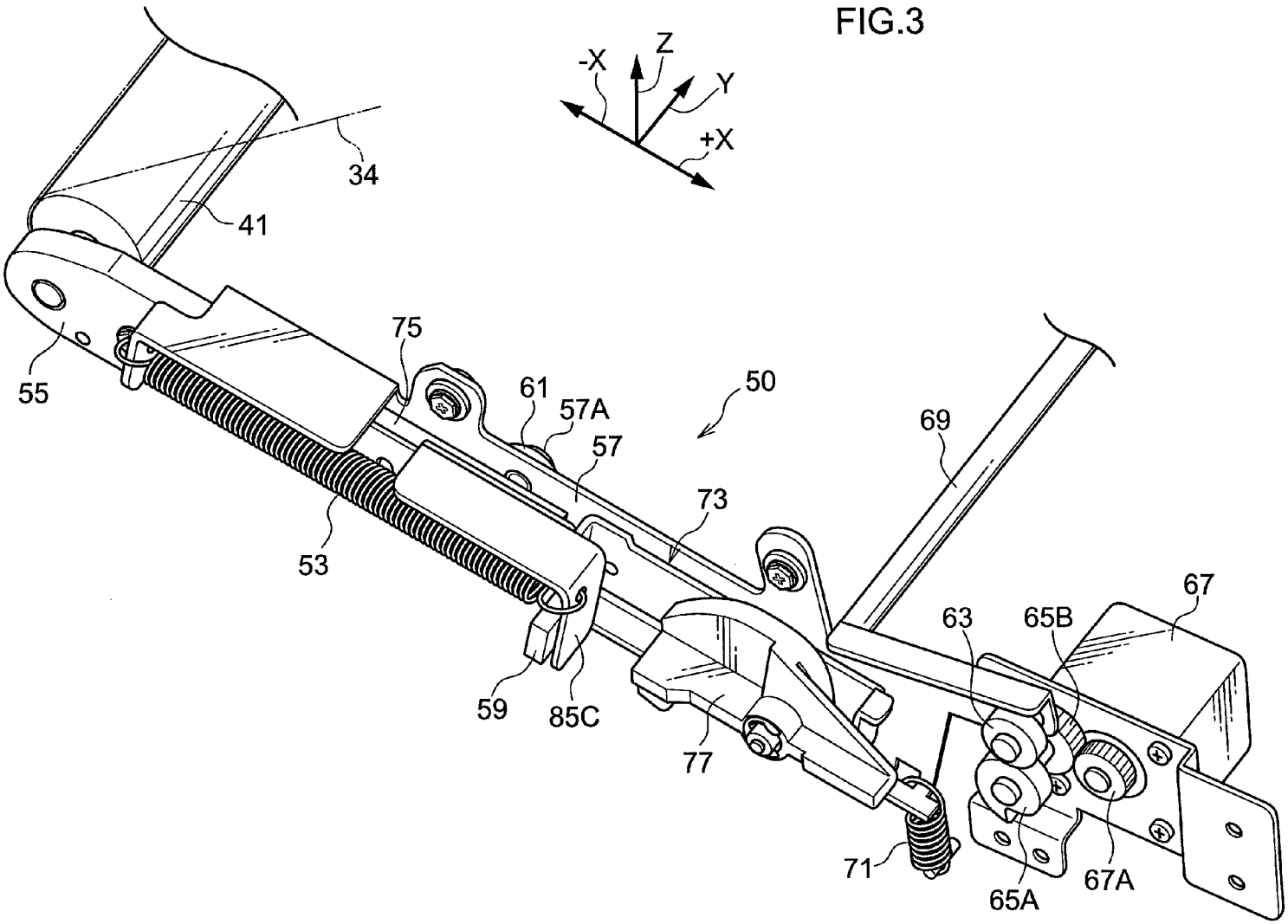
FIG. 3 is a perspective diagram illustrating a portion of a tension application unit relating to the exemplary embodiment of the present invention.

As illustrated in FIG. 1, the transfer device 30 is structured to include the intermediate transfer belt 34, six first transfer rollers 36, a driving roller 38, a tension application roller 41, the support roller 42, plural support rollers 44 and a damping member 59 (see FIG. 3). The intermediate transfer belt 34, which touches against the photoreceptors 18 (see FIG. 2), serves as an example of an endless transfer belt. The first transfer rollers 36 are disposed at the inner side of the intermediate transfer belt 34 and superposingly transfer the toner images formed on the photoreceptors 18 onto the intermediate transfer belt 34. The driving roller 38 is driven by an unillustrated motor. The tension application roller 41 structures a tension application unit 50 that serves as a tension application unit, which applies tension to the intermediate transfer belt 34. The support roller 42 is disposed to oppose the second transfer roller 62, sandwiching the intermediate transfer belt 34. The second transfer roller 62, which is described below, serves as an example of a transfer member. The damping member 59, which is described below, causes damping force to act on the tension application unit 50.

The intermediate transfer belt 34 is an endless member and is wound around the six first transfer rollers 36, the driving roller 38, the tension application roller 41, the support roller 42 and the plural support rollers 44. The intermediate transfer belt 34 includes six first transfer portions T1 at which toner images (developer images) are transferred from the photoreceptors 18 by the respective first transfer rollers 36, and the second transfer portion T2, at which the first-transferred toner images are transferred onto the sheet member P by the second transfer roller 62. The intermediate transfer belt 34 retains the toner images at an outer periphery face thereof and is moved to turn in the direction of arrow B (the counterclockwise direction in the drawing) by the driving roller 38, to the second transfer portion T2 from the first transfer portions T1.

Each first transfer roller 36 is disposed to oppose the photoreceptor 18 of the respective image forming unit 16, sandwiching the intermediate transfer belt 34. A first transfer bias voltage of a polarity opposite to a polarity of the toner is applied to the first transfer roller 36 by an electricity supply unit (not illustrated). The toner image formed on the photoreceptor 18 is first-transferred at the first transfer portion T1 of the intermediate transfer belt 34 by this structure. Meanwhile, a cleaning blade 46 is disposed opposite the driving roller 38, sandwiching the intermediate transfer belt 34. A distal end portion of the cleaning blade 46 touches against the intermediate transfer belt 34. The cleaning blade 46 removes residual toner, paper dust and the like on the intermediate transfer belt 34 that is moving to turn.

A second transfer bias voltage of the opposite polarity to the toner polarity is applied to the second transfer roller 62 by an electricity supply unit (not illustrated). The second transfer roller 62 sandwiches the sheet member P against the intermediate transfer belt 34 at the second transfer portion T2, and transfers toner images onto a sheet member P. With this structure, the toner images of the respective colors that have been superposingly transferred onto the intermediate transfer belt 34 are second-transferred by the second transfer roller 62 onto the sheet member P that has been transported thereto along the transport path 60.

Next, the tension application unit 50 and the damping member 59 are described.

As illustrated in FIG. 3, the tension application unit 50 is disposed at the inner side of the intermediate transfer belt 34. The tension application unit 50 includes the tension application roller 41, a coil spring 53, a support bracket 55, and another bracket and coil spring (not illustrated). The tension application roller 41, which touches against the inner periphery face of the intermediate transfer belt 34, serves as an example of a tension application member. The coil spring 53, which is disposed at the one end side of the tension application roller 41, serves as an example of a resilient member (a elastic member). The support bracket 55 supports one end of the tension application roller 41, urges the intermediate transfer belt 34 in the direction of arrow −X with resilient force of the coil spring 53, and serves as an example of a tension application member that applies tension. The other bracket and coil spring are disposed at the other end side of the tension application roller 41 and support the other end of the tension application roller 41.

Figure 4:
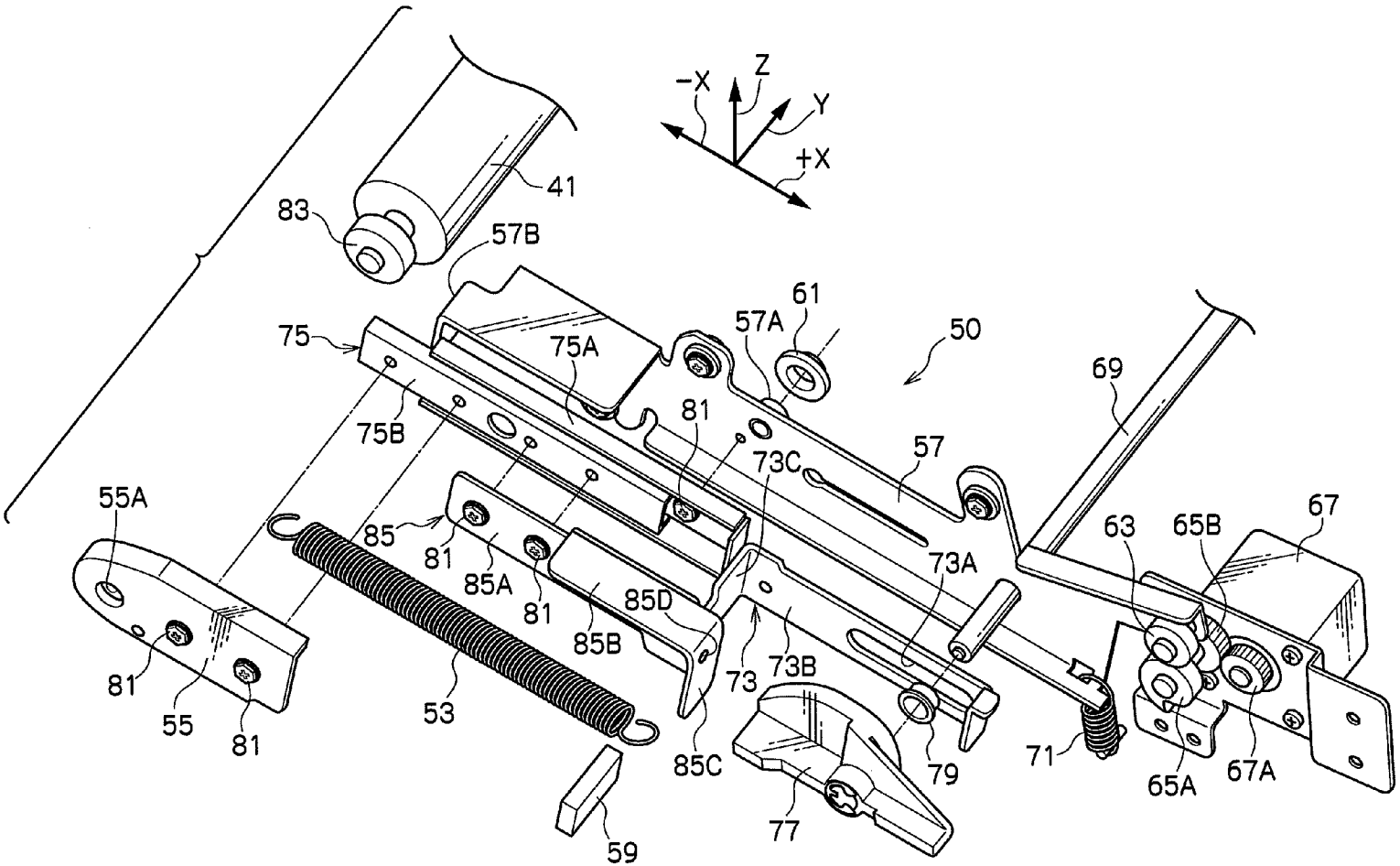
FIG. 4 is a perspective diagram illustrating a disassembled state of the tension application unit relating to the exemplary embodiment of the present invention.

In more detail, as illustrated in FIG. 4, the tension application unit 50 includes a first bracket 57, a longitudinal direction of which is in the direction of arrow X. A cylindrical rod-shaped support shaft portion 57A that protrudes in the direction of arrow Y (a width direction orthogonal to the direction of movement of the intermediate transfer belt 34) is disposed at an upper portion of an arrow X direction central vicinity of the first bracket 57. This support shaft portion 57A is supported by an unillustrated main body via a bearing 61. Thus, the first bracket 57 can be swung about the axis of the support shaft portion 57A. In the descriptions below, the direction in which the tension application roller 41 urges the intermediate transfer belt 34 with the resilient force of the coil spring 53 (see FIG. 3) is represented as the −X direction, and a direction in which the tension application roller 41 is pushed back by the intermediate transfer belt 34 is represented as the +X direction.

One end of a coil spring 71 is attached to a lower portion close to a +X direction end portion of the first bracket 57. The coil spring 71 pulls the +X direction end portion of the first bracket 57 downward. The other end of the coil spring 71 is attached to a floor plate (not illustrated).

A roller 63 is rotatably provided at a +X direction end portion of the first bracket 57. The roller 63 touches against a cam 65A, which is provided at the outer side of the first bracket 57, due to urging force of the coil spring 71. The cam 65A is rotatable integrally with a rotatably provided relay gear 65B. The relay gear 65B meshes with a driving gear 67A provided at a motor for driving 67. Therefore, the first bracket 57 swings in the X-Z plane about the axis of the support shaft portion 57A when the motor 67 operates. The bracket provided at the opposite side of the tension application roller 41 (not illustrated) does not swing. If the intermediate transfer belt 34 offsets to one side in the axial direction (the direction of arrow Y), the motor 67 is driven and the first bracket 57 is swung by the cam 65A. Thus, the tension application roller 41 moves in the X-Y plane, and the intermediate transfer belt 34 returns to the opposite side.

A cylindrical rod-shaped shaft 69 is provided at an upper portion near to the +X direction end portion of the first bracket 57 (the opposite end of the first bracket 57 from the side at which the tension application roller 41 is disposed). The shaft 69, the longitudinal direction of which is in the direction of arrow Y, extends to the tension application unit 50 at the other end portion. An end portion of the shaft 69 protrudes to the outer side through the first bracket 57. A second bracket 73, a longitudinal direction of which is in the direction of arrow X, is provided adjacent to the first bracket 57. The end portion of the shaft 69 passes through a long hole 73A in the second bracket 73. A circular tube-shaped support member 75 is fitted round (from outer side) the end portion of the shaft 69, and a cam member 77 is attached to the end portion of the shaft 69. The cam member 77 is for releasing the tension application roller 41. When the intermediate transfer belt 34 is to be replaced, it is necessary for the tension application roller 41 to be released (away). At this time, the cam member 77 is turned by hand, and the cam member 77 has the function of moving the tension application roller 41 to a release position and retaining the tension application roller 41. The long hole 73A has a longitudinal direction in the direction of arrow X.

The second bracket 73 is structured to include a first sidewall portion 73B and a second sidewall portion 73C. The long hole 73A is formed at the first sidewall portion 73B, and the first sidewall portion 73B is disposed to be parallel with the first bracket 57. The second sidewall portion 73C is bent round in a right angle, to the opposite side from the direction of arrow Y, from an end portion of the first sidewall portion 73B. The second bracket 73 does not relatively move in the X direction with respect to the first bracket 57.

A third bracket 85, a longitudinal direction of which is in the arrow X direction, is disposed at the −X direction side relative to the second bracket 73. The third bracket 85 is structured to include a first sidewall portion 85A, an upper wall portion 85B, and an attachment portion 85C. The first sidewall portion 85A is disposed to be parallel with the first bracket 57. The upper wall portion 85B is bent round to a right angle, to the opposite side from the direction of arrow Y, from an upper end of the first sidewall portion 85A. The attachment portion 85C is bent round, to the side opposite from the direction of arrow Z (downward), from a +X direction end portion of the upper wall portion 85B. A penetration hole 85D is formed in an upper portion of the attachment portion 85C. A +X direction end portion of the coil spring 53 is fixed at the penetration hole 85D. A −X direction end portion of the coil spring 53 is fixed to a fixing portion 57B, which is provided at the −X direction end portion of the first bracket 57.

A sliding member 75 is disposed in a region enclosed by the first bracket 57, the second sidewall portion 73C of the second bracket 73 and the first sidewall portion 85A of the third bracket 85. The sliding member 75 is structured by a fixed portion 75A and a sliding portion 75B. The fixed portion 75A is fixed to the first bracket 57 by a screw member 81, having a letter U-like cross-section in the Y-Z plane. The sliding portion 75B, a longitudinal direction of which is in the X direction, is retained at the fixed portion 75A and is movable in the +X direction and the −X direction.

The first sidewall portion 85A of the third bracket 85 is fixed by screw members 81 to the sliding portion 75B at the +X direction side relative to the middle of the sliding portion 75B. Meanwhile, the support bracket 55 is fixed by screw members 81 to the sliding portion 75B at the −X direction side relative to the middle of the sliding portion 75B. A through hole 55A, through which a shaft 41A that is a rotation axle of the tension application roller 41 passes, is formed at an end portion of the support bracket 55. A bearing 83 is fitted round (from outer side) the shaft 41A, the tension application roller 41 is passed through the through hole 55A, and the bearing 83 is retained. Thus, the tension application roller 41 is rotatably supported. An urging force in the −X direction acts on the tension application roller 41 due to a force of the coil spring 53 in a tensed (pulled out) state (extended relative to a free length) acting to contract (shrink).

The damping member 59 is disposed at the third bracket 85 at the lower side relative to the penetration hole 85D of the attachment portion 85C and at the −X direction side relative to the attachment portion 85C. The damping member 59 is formed in a rectangular solid shape, and is structured of a material with a rebound resilience (impact resilience) of less than 10% as defined by JIS K6255. As an example of the damping member 59, HANENAITO (registered trademark) from Naigai Rubber Industry Co., Ltd. may be mentioned.

Figure 6A:
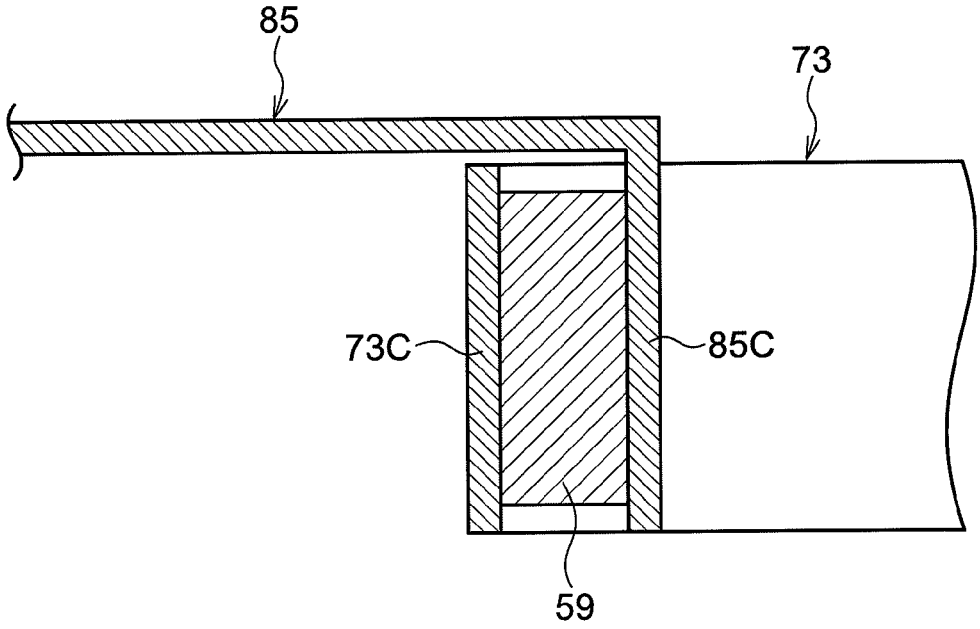
FIG. 6A and FIG. 6B are sectional diagrams illustrating states in which a portion of the tension application unit relating to the exemplary embodiment of the present invention touches against a damping member.

As illustrated in FIG. 6A, the damping member 59 is sandwiched by the second sidewall portion 73C of the second bracket 73 and the attachment portion 85C of the third bracket 85, so as not to disengage. The damping member 59 may be fixed to the second sidewall portion 73C or the attachment portion 85C. In response to a movement of the tension application roller 41 in the direction in which the tension application roller 41 (see FIG. 3) urges the intermediate transfer belt 34 (see FIG. 3) (the −X direction), the damping member 59 is compressed between the second sidewall portion 73C and the attachment portion 85C, and causes a damping force to act on the third bracket 85, which is moved integrally with the tension application roller 41.

Next, operation of the present exemplary embodiment is described.

First, an image forming process of the image forming device 10 is described.

As illustrated in FIG. 1, when the respective units of the image forming device 10 are in operational states, image data to which image processing has been applied by the control section 13 is converted to colorant gradation data of the respective colors, and is serially outputted to the exposure units 40. At the exposure units 40, respective exposure lights L corresponding to the colorant gradation data of the respective colors are emitted, scanning exposure is applied to the photoreceptors 18 that have been charged up by the scorotron chargers 20 (see FIG. 2), and electrostatic latent images are formed. The electrostatic latent images formed on the photoreceptors 18 (see FIG. 2) are made visible as toner images of the respective colors—the first special color (V), the second special color (W), yellow (Y), magenta (M), cyan (C) and black (K)—by the developing devices 22 and thus development is performed.

Then, the toner images of the respective colors that have been formed on the photoreceptors 18 of the image forming units 16V, 16W, 16Y, 16M, 16C and 16K are sequentially superposedly transferred onto the intermediate transfer belt 34 by the first transfer rollers 36V, 36W, 36Y, 36M, 36C and 36K. The color toner images of the respective colors that have been superposedly transferred onto the intermediate transfer belt 34 are second-transferred by the second transfer roller 62 onto a sheet member P that is transported thereto from the paper supply cassettes 48. The sheet member P to which the toner images have been transferred is transported by the transport portions 70 to the fixing unit 82 provided inside the second processing section 10B.

Then, the toner images of the respective colors on the sheet member P are heated and pressured by the fixing unit 82, and thus fixed to the sheet member P. The sheet member P to which the toner images have been fixed passes through the cooling unit 110. In the cooling unit 110, the sheet member P is transported while being sandwiched between the heat-receiving belt 116 and the transport belt 130, and the sheet member P is cooled by the cooling portion 120. The sheet member P that has been cooled is fed into the decurling processing unit 140, and curl occurring in the sheet member P is rectified. The sheet member P whose curl has been rectified is then ejected to the ejection section 196 by the ejection roller 198.

If an image is to be formed at a non-image face at which the image has not been formed (two-sided printing), the sheet member P is fed to the inversion unit 200 by a switching member (not illustrated). The sheet member P that has been fed to the inversion unit 200 passes along the inversion path 202 and is inverted, and fed into the transport path 60 provided above the paper supply cassette 48, and a toner image is formed at the rear face by the sequence described above.

Next, operation of the damping member 59 of the transfer device 30 is described.

Figure 5A:
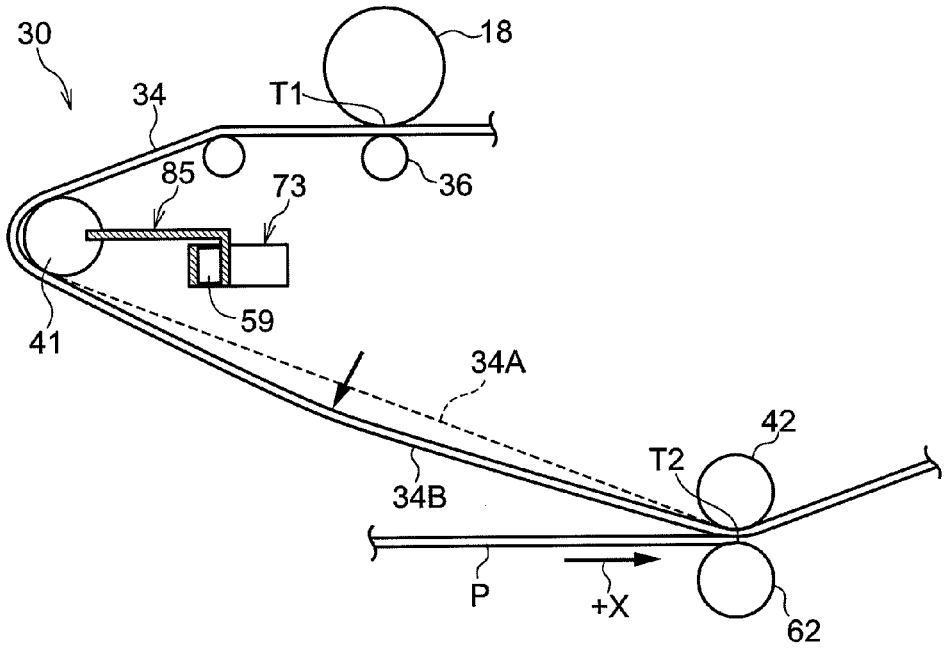
FIG. 5A and FIG. 5B are schematic diagrams illustrating changes of shape of an intermediate transfer belt when recording paper enters a second transfer portion relating to the exemplary embodiment of the present invention.
Figure 5B:
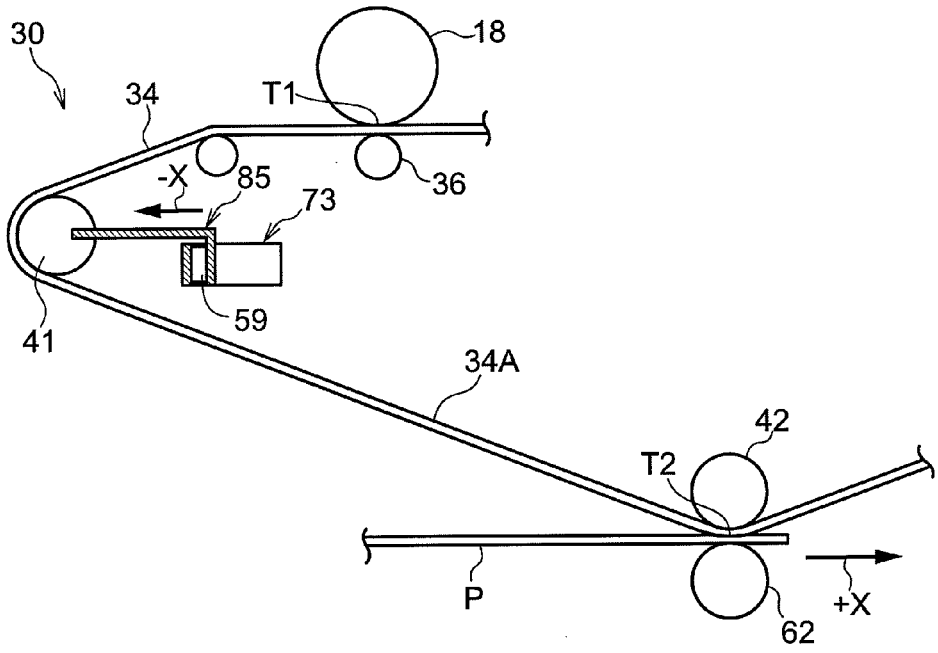

As illustrated in FIG. 5A, when a leading end of the sheet member P enters (pushes into) the second transfer portion T2, the intermediate transfer belt 34 receives a load due to the entry of the sheet member P, and the movement speed of the intermediate transfer belt 34 at the second transfer portion T2 decreases. As a result, the intermediate transfer belt 34 between the tension application roller 41 and the support roller 42 becomes a state (illustrated by the solid line 34B) that is relaxed from the original tensed state (illustrated by the broken line 34A). Thus, as illustrated in FIG. 5B, the tension application roller 41 offsets to the direction of tensing the intermediate transfer belt 34 (the −X direction).

Figure 6B:
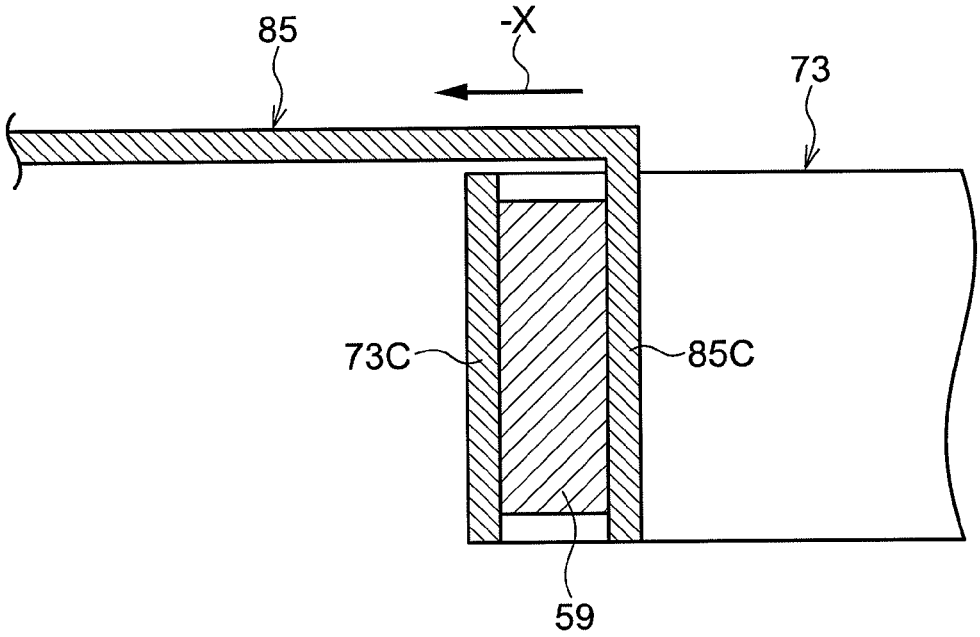

At this time, as illustrated in FIG. 6B, the third bracket 85 relatively moves in the −X direction with respect to the second bracket 73. Consequently, the damping member 59 is compressed by the second sidewall portion 73C and the attachment portion 85C, and damping force acts on the third bracket 85. The tension application roller 41 displaces integrally with the third bracket 85, and, as illustrated in FIG. 5B, the tension application roller 41 touches against the intermediate transfer belt 34 and follows, while displacement of the tension application roller 41 in the −X direction (overshooting) is suppressed. Therefore, mispositioning of the intermediate transfer belt 34 at the first transfer portions T1 is reduced.

Figure 7A:
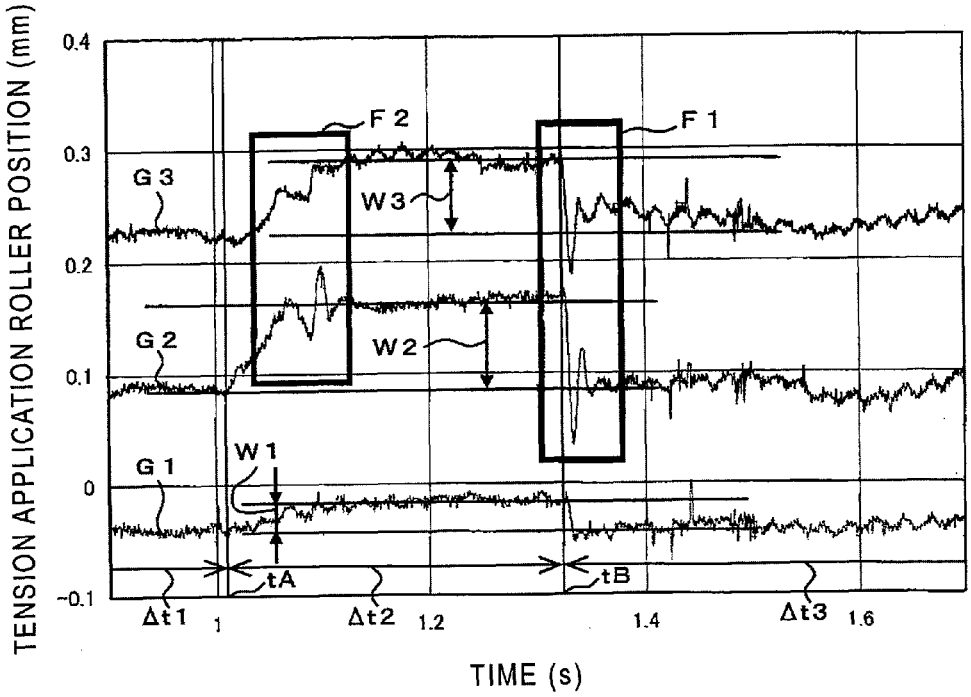
FIG. 7A is a graph illustrating changes in position with time of a tension application roller relating to the exemplary embodiment of the present invention.
Figure 7B:
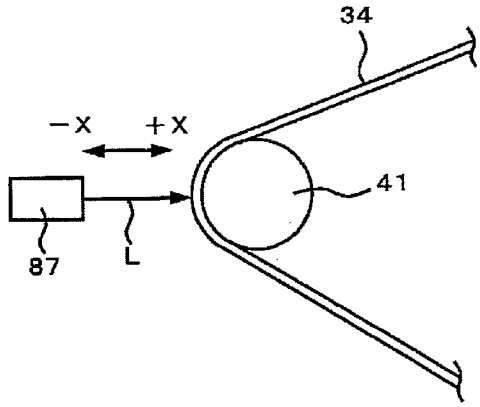
FIG. 7B is a schematic diagram illustrating a method of measurement of the changes in position of the tension application roller relating to the exemplary embodiment of the present invention.

In FIG. 7A, relationships between time and positions of the tension application roller 41 in the arrow X direction are illustrated for the present exemplary embodiment (graph G3), a case that is a comparative example in which the damping members 59 are disposed at both the −X direction and +X direction sides of vibrations of the intermediate transfer belt 34 and tension application roller 41 (graph G1), and a case in which the damping member 59 is not provided (graph G2). The symbol Δt1 represents a period when a first sheet member P has entered the second transfer portion T2, Δt2 represents a period when there is no sheet member P at the second transfer portion T2, and Δt3 represents a period when a second sheet member P is entering the second transfer portion T2. Further, tA represents a time in which the trailing end of the first sheet member P is leaving the second transfer portion T2, and tB represents a time in which the leading end of the second sheet member P is entering the second transfer portion T2. Further still, W1 represents a difference between positions of the tension application roller 41 between when the sheet member P is present and absent in graph G1 (a displacement amount), W2 represents a displacement amount of the tension application roller 41 between when the sheet member P is present and absent in graph G2, and W3 represents a displacement amount of the tension application roller 41 between when the sheet member P is present and absent in graph G3. The graphs G1, G2 and G3 are shown with origin positions thereof offset. Measurement of the positions of the tension application roller 41 is conducted by measuring displacements of the tension application roller 41 in the directions of the arrows −X and +X with a laser displacement meter 87, as illustrated in FIG. 7B.

As illustrated in FIG. 7A, from graph G1 of the case in which the damping member 59 is disposed at both the +X direction and the −X direction sides of vibrations of the intermediate transfer belt 34 and tension application roller 41, which is a comparative example, the displacement amount W1 of the tension application roller 41 in accordance with the presence or absence of a sheet member P is seen to be much smaller than the displacement amount W2 of the case in which the damping member 59 is not provided and the displacement amount W3 of the present exemplary embodiment in which the damping member 59 is disposed at one side. Therefore, in a case where the comparative example structure of graph G1 is used, when the leading end of a sheet member P enters the second transfer portion T2 and the intermediate transfer belt 34 slackens, the tension application roller 41 does not manage to follow the intermediate transfer belt 34 and the intermediate transfer belt 34 stays slack, which causes disruption of the toner images being transferred onto the sheet member P. Moreover, in the comparative example structure of graph G1, although vibrations of the intermediate transfer belt 34 are small, secondary problems such as flapping due to the looseness of the intermediate transfer belt 34 and the like become significant. In other words, with the present exemplary embodiment it is seen that because the displacement amount W3 is larger than the displacement amount W1 of the comparative example, the ability of the tension application roller 41 to follow the intermediate transfer belt 34 when the intermediate transfer belt 34 slackens is high.

Furthermore, in FIG. 7A, when graph G2 (the damping member 59 is not disposed), which is a comparative example, is compared with graph G3 of the present exemplary embodiment, it is seen, particularly in the range enclosed by frame F1 (just after the leading end of the sheet member P enters the second transfer portion T2), that although an initial impact at the time of entry of the leading end of the sheet member P cannot be absorbed in either case, in subsequent vibrations, graph G2 of the comparative example has larger amplitude than graph G3 of the present exemplary embodiment. In other words, it is seen that with the present exemplary embodiment the amplitude is smaller than in graph G2 of the comparative example, and a vibration damping effect is obtained by the damping member 59. It is also seen from FIG. 7A that the vibration damping effect by the damping member 59 of the present exemplary embodiment is also obtained in the range enclosed by frame F2 (when the trailing end of the sheet member P is ejected from the second transfer portion T2).

Thus, in the present exemplary embodiment, due to that the damping member 59 is disposed only at one side of the vibration direction of the intermediate transfer belt 34 and tension application roller 41 and damps vibrations, restraint of displacement of the tension application roller 41 is reduced, and the damping member 59 follows displacement of the intermediate transfer belt 34 while applying damping force to the tension application roller 41. Thus, the propagation of vibrations from the second transfer portion T2 to the first transfer portions T1 is reduced.

Furthermore, in the present exemplary embodiment, due to that the damping member 59 is disposed at the direction in which the intermediate transfer belt 34 and the tension application roller 41 initially move (the −X direction) in response to entry of a sheet member P (a step input), a damping force can be caused to act during an initial half-cycle after the generation of a vibration of the intermediate transfer belt 34 and tension application roller 41. Therefore, the damping can be commenced from an earlier period than a case where the damping member 59 is provided at the opposite direction (the +X direction) (a case where vibration damping is caused after the passage of a half-cycle period after the generation of a vibration). Thus, vibrations of the intermediate transfer belt 34 at the first transfer portions T1 are suppressed at an earlier stage.

In FIG. 3, at the tension application unit 50, when the intermediate transfer belt 34 offsets to one direction in the axial direction (the direction of arrow Y), the motor 67 is driven and the first bracket 57 is swung by the cam 65A, and the intermediate transfer belt 34 returns to the opposite side. Here, the positioning relationship between the tension application roller 41 and the damping member 59 does not change even if the first bracket 57 swings, and the damping effect is unchanged.

The present invention is not to be limited by the above exemplary embodiment.

The first transfer portions T1 are not necessarily at six locations but may be at one location or a plural number of locations that is two or more locations (apart from six locations). Further, the tension application unit 50 need not include the mechanism for swinging of the first bracket 57 by the motor 67. Further yet, the damping member 59 may be provided only at the +X arrow direction side with respect to second sidewall portion 73C of the second bracket 73. Further still, the shape of the damping member 59 is not to be limited to a rectangular solid shape, and may include curved surfaces.

What is claimed is:

1. A transfer device comprising:

an endless transfer belt that includes a first transfer portion, at which a developer image is transferred onto an outer periphery surface of the transfer belt, and a second transfer portion, at which the developer image is transferred onto a member to be transferred, the transfer belt moving toward the second transfer portion from the first transfer portion;

a transfer member that, at the second transfer portion, sandwiches the member to be transferred between the transfer member and the transfer belt, and transfers the developer image to the member to be transferred;

a tension application unit that includes a resilient member, and a tension application member that urges the transfer belt with resilient force of the resilient member and applies tension to the transfer belt; and a damping member that causes damping force to act on the tension application member when the tension application member moves in one of a direction in which the tension application member urges the transfer belt, or an opposite direction.

2. The transfer device of claim 1, wherein the damping member is provided so as to cause damping force to act on the tension application member when the tension application member moves in the direction in which the tension application member urges the transfer belt.

3. The transfer device of claim 2, wherein the damping member is provided so as to cause damping force to act on the tension application member by being compressed when the tension application member moves in the direction in which the tension application member urges the transfer belt.

4. The transfer device of claim 1, wherein rebound resilience of the damping member is less than 10%.

5. The transfer device of claim 1, wherein the tension application member is a tension application roller that applies the tension to the transfer belt by contacting an inner periphery surface of the transfer belt.

6. The transfer device of claim 5, wherein the tension application unit further includes a first bracket, a second bracket that is attached to the first bracket so as not to relatively move in the direction of urging the transfer belt and in the opposite direction with respect to the first bracket, and a third bracket that is displaced integrally with the tension application roller in the direction of urging the transfer belt and in the opposite direction, the damping member is provided between the second bracket and the third bracket, and the damping member causes the damping force to act on the tension application roller by being compressed by the second bracket and the third bracket when the tension application roller moves in the direction in which the tension application roller urges the transfer belt.

7. The transfer device of claim 6, wherein one end of the resilient member is connected to the first bracket and the other end of the resilient member is connected to the third bracket.

8. An image forming device comprising:

a transfer device including:

an endless transfer belt that includes a first transfer portion, at which a developer image is transferred onto an outer periphery surface of the transfer belt, and a second transfer portion, at which the developer image is transferred onto a member to be transferred, the transfer belt moving toward the second transfer portion from the first transfer portion;

a transfer member that, at the second transfer portion, sandwiches the member to be transferred between the transfer member and the transfer belt, and transfers the developer image to the member to be transferred;

a tension application unit that includes a resilient member, and a tension application member that urges the transfer belt with resilient force of the resilient member and applies tension to the transfer belt; and a damping member that causes damping force to act on the tension application member when the tension application member moves in one of a direction in which the tension application member urges the transfer belt, or an opposite direction, and a developer image forming unit that forms the developer image that is to be transferred to the transfer belt.

9. The image forming device of claim 8, wherein the damping member is provided so as to cause damping force to act on the tension application member when the tension application member moves in the direction in which the tension application member urges the transfer belt.

10. The image forming device of claim 9, wherein the damping member is provided so as to cause damping force to act on the tension application member by being compressed when the tension application member moves in the direction in which the tension application member urges the transfer belt.

11. The image forming device of claim 8, wherein rebound resilience of the damping member is less than 10%.

12. The image forming device of claim 8, wherein the tension application member is a tension application roller that applies the tension to the transfer belt by contacting an inner periphery surface of the transfer belt.

13. The image forming device of claim 12, wherein the tension application unit further includes a first bracket, a second bracket that is attached to the first bracket so as not to relatively move in the direction of urging the transfer belt and in the opposite direction with respect to the first bracket, and a third bracket that is displaced integrally with the tension application roller in the direction of urging the transfer belt and in the opposite direction, the damping member is provided between the second bracket and the third bracket, and the damping member causes the damping force to act on the tension application roller by being compressed by the second bracket and the third bracket when the tension application roller moves in the direction in which the tension application roller urges the transfer belt.

14. The image forming device of claim 13, wherein one end of the resilient member is connected to the first bracket and the other end of the resilient member is connected to the third bracket.

* * * * *